US011551627B2

(12) United States Patent
Zhao

(10) Patent No.: US 11,551,627 B2
(45) Date of Patent: Jan. 10, 2023

(54) ARRAY SUBSTRATE AND LIQUID CRYSTAL DISPLAY PANEL

(71) Applicant: TCL CHINA STAR OPTOELECTRONICS TECHNOLOGY CO., LTD., Guangdong (CN)

(72) Inventor: Li Zhao, Guangdong (CN)

(73) Assignee: TCL CHINA STAR OPTOELECTRONICS TECHNOLOGY CO., LTD., Guangdong (CN)

( * ) Notice: Subject to any disclaimer, the term of this patent is extended or adjusted under 35 U.S.C. 154(b) by 63 days.

(21) Appl. No.: 16/972,614

(22) PCT Filed: Oct. 30, 2020

(86) PCT No.: PCT/CN2020/125052
§ 371 (c)(1),
(2) Date: Dec. 7, 2020

(87) PCT Pub. No.: WO2022/057027
PCT Pub. Date: Mar. 24, 2022

(65) Prior Publication Data

US 2022/0189427 A1 Jun. 16, 2022

(30) Foreign Application Priority Data

Sep. 17, 2020 (CN) ..... 202010982423.3

(51) Int. Cl.
*G09G 3/36* (2006.01)

(52) U.S. Cl.
CPC ..... *G09G 3/3614* (2013.01); *G09G 3/3677* (2013.01); *G09G 3/3688* (2013.01); *G09G 2300/0408* (2013.01)

(58) Field of Classification Search
CPC ..... G09G 3/3614; G09G 3/3677; G09G 3/3688; G09G 2300/0408
See application file for complete search history.

(56) References Cited

U.S. PATENT DOCUMENTS 10,304,397 B2 5/2019 Kim
2010/0110046 A1* 5/2010 Chen ..... G09G 3/3614 345/204

(Continued)

FOREIGN PATENT DOCUMENTS

CN 101387804 A 3/2009
CN 102087842 A 6/2011

(Continued)

*Primary Examiner* — David Tung
(74) *Attorney, Agent, or Firm* — PV IP PC; Wei Te Chung; Ude Lu

(57) ABSTRACT

An array substrate and a display panel are provided. The array substrate includes pixel units arranged in an array, and the pixel units include at least two sub-pixels in a same row. Driving polarities of sub-pixels in a same pixel unit are same. The driving polarities include a positive frame driving and a negative frame driving, wherein in a row direction, driving polarities of sub-pixels of adjacent pixel units are different, and in a column direction, driving polarities of adjacent first-row pixel units and second-row pixel units are different.

13 Claims, 5 Drawing Sheets

(56) References Cited

U.S. PATENT DOCUMENTS

| | | | | |
|---|---|---|---|---|
| 2013/0147698 | A1* | 6/2013 | Kang | G09G 3/3674 345/87 |
| 2014/0225819 | A1* | 8/2014 | Onuma | G09G 3/3648 345/87 |
| 2016/0267862 | A1* | 9/2016 | Yao | G09G 3/3685 |
| 2016/0275888 | A1 | 9/2016 | Chen | |
| 2018/0114478 | A1* | 4/2018 | Tien | G09G 3/2074 |
| 2019/0164513 | A1* | 5/2019 | Wu | G02F 1/136286 |
| 2021/0090515 | A1 | 3/2021 | Huang | |

FOREIGN PATENT DOCUMENTS

| | | | |
|---|---|---|---|
| CN | 104062820 | A | 9/2014 |
| CN | 104280962 | A | 1/2015 |
| CN | 106067293 | A | 11/2016 |
| CN | 107741660 | A | 2/2018 |
| CN | 108109596 | A | 6/2018 |
| CN | 109616064 | A | 4/2019 |
| CN | 111258139 | A | 6/2020 |
| KR | 20110064114 | A | 6/2011 |
| KR | 20110064116 | A | 6/2011 |

* cited by examiner

ARRAY SUBSTRATE AND LIQUID CRYSTAL DISPLAY PANEL

FIELD OF INVENTION

The present application relates to the field of display, in particular to an array substrate and a liquid crystal display panel.

BACKGROUND OF INVENTION

With continuous advancements made in liquid crystal display technology, liquid crystal display panels, as a display component, have been widely used in electronic products such as mobile phones, digital cameras, and personal digital assistants (PDAs). Currently, a solution of data line sharing (DLS) is usually adopted to reduce manufacturing cost of the liquid crystal display panels. FIG. 1 shows a schematic diagram of pixel arrangement of an array substrate adopting a DLS architecture in the prior art. As shown in FIG. 1, the array substrate includes a gate line and a data line. The data line and two adjacent gate lines enclose a pixel unit, wherein driving polarities of pixel units in each column are same, and driving polarities of pixel units in odd rows and even columns are different. Take pixel areas 10 and 20 enclosed by data lines D1, D2, and D3 as an example for specific description. The pixel unit includes two sub-pixels, which are connected to high voltage and low voltage, respectively. In a column direction, polarities of pixel driving units in the pixel area 10 are same, polarities of pixel driving units in the pixel area 20 are same, and the polarities of the pixel driving units in the pixel area 10 and that of the pixel area 20 are different. In this way, when the display panel performs frame inversion, a frequency of sub-pixel conversion of the array substrate in the column direction is same, and dynamic dark lines or other phenomena are prone to appear, which affects display effect.

Therefore, the problem of dynamic dark lines easily occurring when the display panel switches between positive frame and negative frame exists in the prior art.

Technical Problem

The embodiments of the present application provide an array substrate and a liquid crystal display panel, which can effectively alleviate the problem in the prior art that dynamic dark lines are prone to occur when the display panel switches between positive frame and negative frame.

SUMMARY OF INVENTION

In a first aspect, the present application provides an array substrate. The array substrate includes pixel units arranged in an array. The pixel units each includes at least two sub-pixels in a same row, wherein driving polarities of the sub-pixels in the same pixel unit are same. The driving polarities include a positive frame driving and a negative frame driving. The array substrate further includes: first-row pixels including a plurality of first pixel units, and driving polarities of sub-pixels of adjacent first pixel units are different; second-row pixels adjacent to the first-row pixels, including a plurality of second pixel units, and driving polarities of sub-pixels of adjacent second pixel units are different. In a column direction, driving polarities of the sub-pixels of adjacent first pixel unit and second pixel unit are different.

In the array substrate provided by the present application, the array substrate further includes: third-row pixels adjacent to the second-row pixels, the third-row pixels including a plurality of third pixel units, and driving polarities of sub-pixels of adjacent third pixel units are different; fourth-row pixels adjacent to the third-row pixels, the fourth-row pixels including a plurality of fourth pixel units, and driving polarities of sub-pixels of adjacent fourth pixel units are different. In a column direction, driving polarities of sub-pixels of adjacent third pixel unit and second pixel unit are different, and driving polarities of sub-pixels of adjacent fourth pixel unit and third pixel unit are different.

In the array substrate provided in the present application, the array substrate further includes: third-row pixels adjacent to the second-row pixels, the third-row pixels including a plurality of third pixel units, and driving polarities of sub-pixels of adjacent third pixel units are different; fourth-row pixels adjacent to the third-row pixels, the fourth-row pixels including a plurality of fourth pixel units, and driving polarities of sub-pixels of adjacent fourth pixel units are different. In the column direction, driving polarities of sub-pixels of adjacent third pixel unit and second pixel unit are same, and driving polarities of sub-pixels of adjacent fourth pixel unit and third pixel unit are different.

In the array substrate provided by the present application, each pixel unit includes two sub-pixels with different light-emitting colors.

In the array substrate provided by the present application, the array substrate is provided with data lines arranged in parallel in the column direction and gate lines arranged in parallel in a row direction, and one pixel unit is connected to one data line and two gate lines.

In the array substrate provided by the present application, driving polarities of sub-pixels of pixel units connected to the same data line are same.

In the array substrate provided by the present application, the same data line is connected to both first pixel unit and second pixel unit.

In the array substrate provided by the present application, in the row direction, sub-pixels of different light emission states are alternately arranged, sub-pixels of same light emission states are connected to the same scan line, and the light emission states comprise a bright state and a dark state.

In the array substrate provided by the present application, in the row direction, gate driver on array (GOA) units corresponding to scan lines connecting sub-pixels of different light emission states are positioned on different sides of a display area.

In a second aspect, the present application provides a liquid crystal display panel, including the above-mentioned array substrate, the array substrate includes the pixel units arranged in the array, the pixel units each including the at least two sub-pixels in the same row, wherein the driving polarities of the sub-pixels in the same pixel unit are same, and the driving polarities include the positive frame driving and the negative frame driving; the array substrate further including: the first-row pixels including the plurality of the first pixel units, and the driving polarities of the sub-pixels of the adjacent first pixel units are different; the second-row pixels adjacent to the first-row pixels, including the plurality of the second pixel units, and the driving polarities of the sub-pixels of the adjacent second pixel units are different; wherein in the column direction, the driving polarities of the sub-pixels of the adjacent first pixel unit and second pixel unit are different.

In the liquid crystal display panel provided by the present application, the array substrate further includes: third-row pixels adjacent to the second-row pixels, the third-row pixels including a plurality of third pixel units, and driving polarities of sub-pixels of adjacent third pixel units are different; fourth-row pixels adjacent to the third-row pixels, the fourth-row pixels including a plurality of fourth pixel units, and driving polarities of sub-pixels of adjacent fourth pixel units are different; wherein in the column direction, driving polarities of sub-pixels of adjacent third pixel unit and second pixel unit are different, and driving polarities of sub-pixels of adjacent fourth pixel unit and third pixel unit are different.

In the liquid crystal display panel provided by the present application, the array substrate further includes: third-row pixels adjacent to the second-row pixels, the third-row pixels including a plurality of third pixel units, and driving polarities of sub-pixels of adjacent third pixel units are different; fourth-row pixels adjacent to the third-row pixels, the fourth-row pixels including a plurality of fourth pixel units, and driving polarities of sub-pixels of adjacent fourth pixel units are different; wherein in the column direction, driving polarities of sub-pixels of adjacent third pixel unit and second pixel unit are same, and driving polarities of sub-pixels of adjacent fourth pixel unit and third pixel unit are different.

In the liquid crystal display panel provided by the present application, each pixel unit includes two sub-pixels with different light-emitting colors.

In the liquid crystal display panel provided by the present application, the array substrate is provided with data lines arranged in parallel in the column direction and gate lines arranged in parallel in a row direction, and one pixel unit is connected to one data line and two gate lines.

In the liquid crystal display panel provided by the present application, driving polarities of sub-pixels of pixel units connected to the same data line are same.

In the liquid crystal display panel provided by the present application, the same data line is connected to both first pixel unit and second pixel unit.

In the liquid crystal display panel provided by the present application, in the row direction, sub-pixels of different light emission states are alternately arranged, sub-pixels of same light emission states are connected to the same scan line, and the light emission states includes a bright state and a dark state.

In the liquid crystal display panel provided by the present application, in the row direction, gate driver on array (GOA) units corresponding to scan lines connecting sub-pixels of different light emission states are positioned on different sides of a display area.

In the liquid crystal display panel provided by the present application, the liquid crystal display panel further includes a data driving chip and a timing controller, the data driving chip is configured to transmit an original signal to the timing controller, and the timing controller is configured to convert the original signal into a timing signal and transmit the timing signal to the GOA unit.

Beneficial Effect

The present application discloses an array substrate and a liquid crystal display panel. The array substrate includes pixel units arranged in an array. The pixel unit includes at least two sub-pixels arranged in the same row, driving polarities of the sub-pixels in the same pixel unit are same, and the driving polarities include positive frame driving and negative frame driving, wherein in the row direction, driving polarities of sub-pixels of adjacent pixel units are different, and in the column direction, driving polarities of adjacent first-row pixel units and second-row pixel units are different. The present application changes the pixel arrangement of the array substrate, and alternately arranges the pixel units driven by the positive frame and the pixel units driven by the negative frame. This alleviates the problem of the prior art that dynamic dark lines occur during frame conversion caused by the pixel units with same driving polarity in the column direction of the array substrate, thereby improving the display effect.

DESCRIPTION OF DRAWINGS

The following describes the specific implementations of the present application in detail with reference to the accompanying drawings, which will make the technical solutions and other beneficial effects of the present application easy to understand.

DETAILED DESCRIPTION OF PREFERRED EMBODIMENTS

Figure 1:
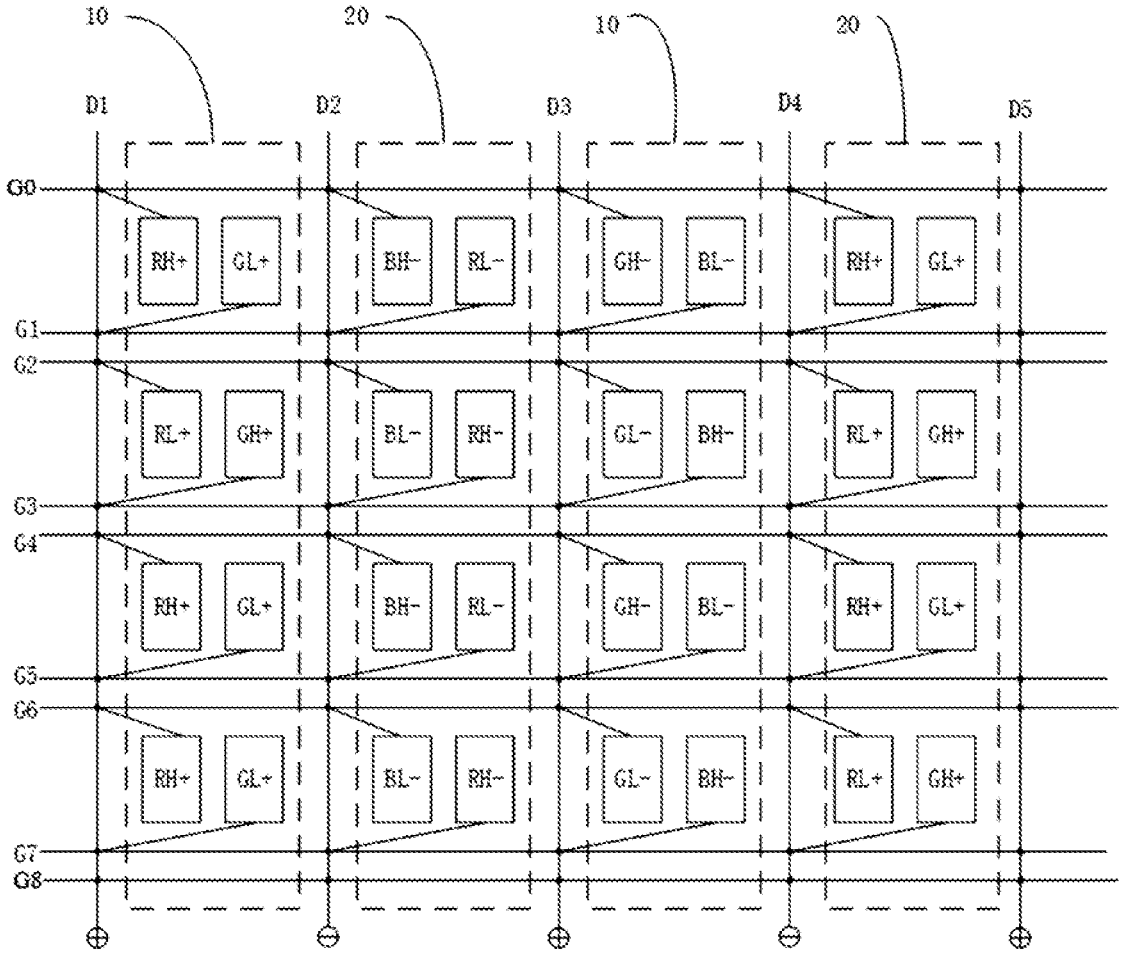
FIG. 1 is a schematic diagram of a pixel arrangement of an array substrate in the prior art.

The technical solutions in the embodiments of the present application will be clearly and completely described below with reference to the drawings in the embodiments of the present application. Obviously, the described embodiments are only a part of the embodiments of the present application, rather than all the embodiments. Based on these embodiments in the present application, all other embodiments obtained by those skilled in the art without doing creative work are within the protection scope of this application.

In the description of the present application, it should be understood that the orientation or positional relationship indicated by the terms "center", "longitudinal", "lateral", "length", "width", "thickness", "above", "below", "front", "back", "left", "right", "upright", "horizontal", "top", "bottom", "inner", "outer", "clockwise", "counterclockwise", etc. are based on the orientation or positional relationship shown in the drawings. It is only for the convenience of describing the application and simplifying the description, rather than indicating or implying that the device or element referred to must have a specific orientation, be constructed and operated in a specific orientation, and therefore cannot be understood as a limitation of the application. In addition, the terms "first" and "second" are only used for descriptive purposes, and cannot be understood as indicating or implying relative importance or implicitly indicating the number of indicated technical features. Therefore, the features defined with "first" and "second" may explicitly or implicitly include one or more of the features. In the description of the present application, "plurality" means two or more than two, unless otherwise specifically defined.

In the description of the present application, it should be noted that the terms "installation", "connected to", or "connection" should be understood in a broad sense, unless otherwise specified and limited. For example, it can be a fixed connection, a detachable connection, or an integral connection. It can be mechanically connected, electrically connected, or can be communicated with each other. It can be directly connected or indirectly connected through an intermediary. It can be a communication between two elements or an interaction relationship between two elements. For those of ordinary skill in the art, the specific meanings of the above terms in the application can be understood according to specific circumstances.

In the present application, unless expressly stipulated and defined otherwise, the first feature above or below the second feature may include direct contact between the first feature and second feature. It may also be included that the first feature and second feature are not in direct contact but in contact with another feature between them. Moreover, the first feature is above the second feature means the first feature being directly above and obliquely above the second feature, or it simply means that a horizontal height of the first feature is higher than that of the second feature. The first feature is below the second feature means the first feature directly below and obliquely below the second feature, or it simply means that a horizontal height of the first feature is lower than that of the second feature.

The following disclosure provides various embodiments or examples for realizing various structures of the present application. To simplify the disclosure of the present application, the components and settings of specific examples are described below. No doubt, they are only examples and are not intended to limit the application. Further, the present application may repeat reference numerals and/or reference letters in different examples, and this repetition is for the purpose of simplification and clarity and does not indicate the relationship between the various embodiments and/or settings discussed. In addition, this application provides examples of various specific processes and materials, but those of ordinary skill in the art may be aware of the application of other processes and/or the use of other materials.

Figure 2:
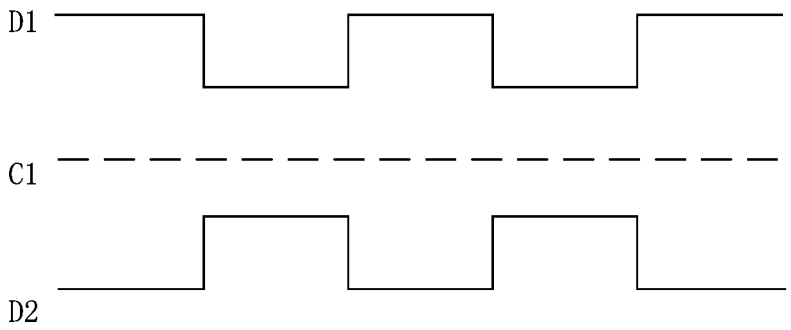
FIG. 2 is a schematic diagram of a positive frame original pixel voltage and a negative frame original pixel voltage relative to a common voltage in the prior art.

As shown in FIG. 1, in the prior art, an array substrate includes gate lines $G_1$, $G_2$, $G_3$ . . . $G_n$, data lines $D_1$, $D_2$, $D_3$ . . . $D_n$, and pixel units arranged in an array. Each pixel unit is connected to a data line and two gate lines. The pixel unit includes at least two sub-pixels arranged in the same row, the driving polarities of the sub-pixels in each pixel unit are same, and the driving polarities include positive frame driving and negative frame driving. The sub-pixels include a red sub-pixel R, a green sub-pixel G, and a blue sub-pixel B. The sub-pixel includes a bright state and a dark state, the bright state is represented by H, and the dark state is represented by L. Pixels connected by positive frame drive are represented by +, and pixels driven by negative frame are represented by −. As shown in FIG. 1, RH+ represents that the red sub-pixel displays a bright state under positive frame driving; the array substrate includes: first-row pixels including a plurality of first pixel units, and driving polarities of sub-pixels of adjacent first pixel units are different; second-row pixels adjacent to the first-row pixels, including a plurality of second pixel units, and driving polarities of sub-pixels of adjacent second pixel units are different; wherein in a column direction, driving polarities of the sub-pixels of adjacent first pixel unit and second pixel unit are same. As shown in FIG. 1, the odd-numbered columns are pixel areas 10 composed of pixel units driven by the positive frame, and the even-numbered columns are pixel areas 20 composed of pixel units driven by negative frames. The data line D1 provides a positive frame electrical signal to the pixel unit in the pixel area 10, and the data line D2 provides a negative frame electrical signal to the pixel unit in the pixel area 20. As shown in FIG. 2, D1 represents a positive frame signal received by the positive frame pixel, and D2 represents a negative frame signal received by the negative frame pixel. The positive frame signal and the negative frame signal are symmetrical with respect to the common electrode voltage of the color filter substrate. The positive frame signal is a positive voltage relative to the common electrode voltage of the color filter substrate, and the negative frame signal is a negative voltage relative to the common electrode voltage of the color filter substrate. The voltage of the common electrode of the color filter substrate is kept unchanged, and an electrical signal with a changed polarity of the voltage is applied to liquid crystal molecules to realize AC driving of the liquid crystal molecules. High potential and low potential of the positive frame voltage and the negative frame voltage correspond to a gray value of light emission of a pixel. The high potential corresponds to a first gray value H, and the low potential voltage corresponds to a second gray value L, the first gray value is a bright state, and the second gray value is a dark state. The two sub-pixels included in the pixel unit respectively correspond to the first gray value and the second gray value. In the column direction, the gray values corresponding to adjacent sub-pixels are different. In this way, when performing frame conversion, the array substrate alternately switches between positive frame pixels and negative frame pixels row by row. Because in the column direction, the frequency of the bright and dark alternation of the sub-pixels is same within the same time period, the entire display panel is likely to form dynamic dark lines, which affects the display effect.

The embodiments of the present application provide an array substrate and a liquid crystal display panel, which can effectively alleviate the problem of dynamic dark lines that are prone to occur when the display panel of the prior art is switched between positive and negative frames. For details, please refer to FIG. 3 to FIG. 5.

Figure 3:
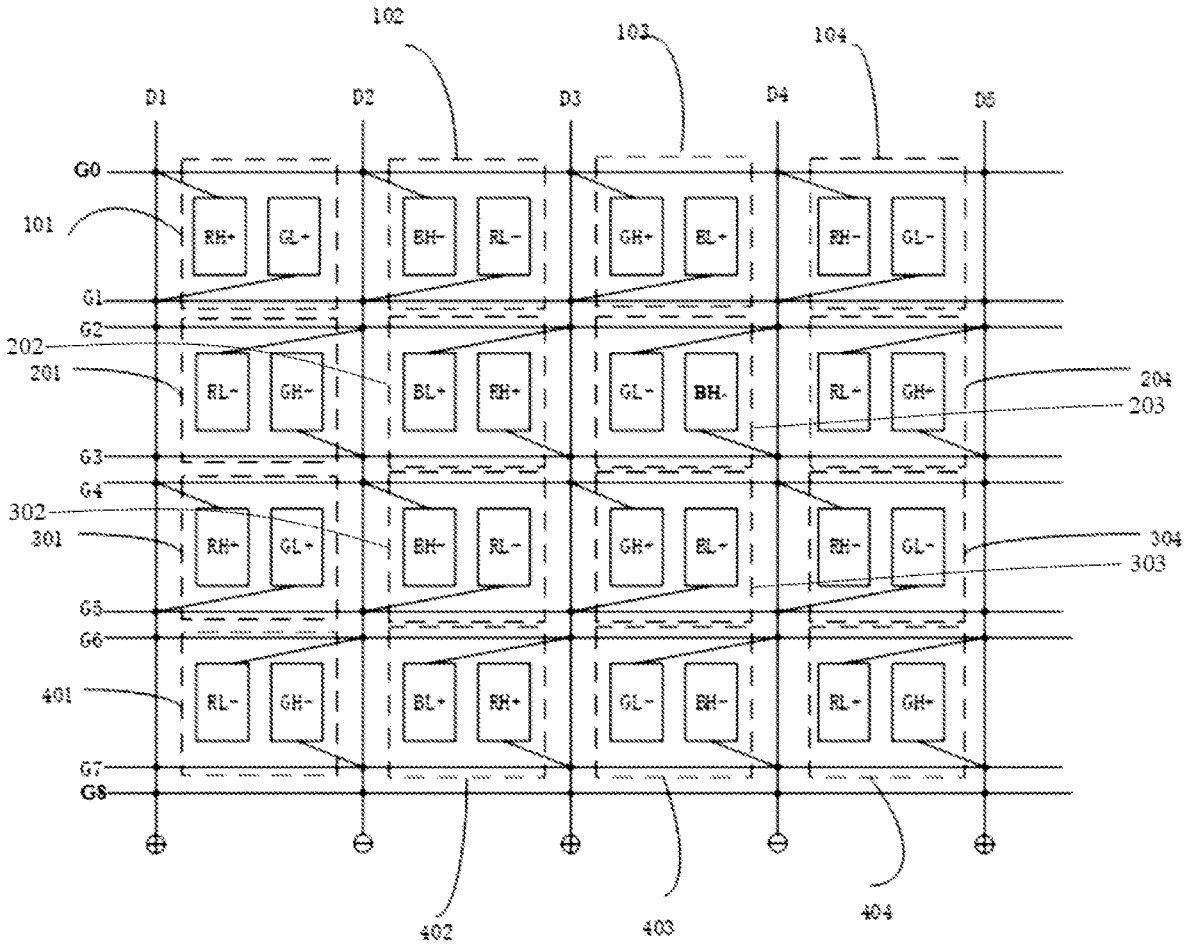
FIG. 3 is a schematic diagram of a pixel arrangement of a first array substrate provided by an embodiment of the present invention.

As shown in FIG. 3, the present application provides an array substrate. The array substrate includes pixel units arranged in an array. The pixel units include at least two sub-pixels arranged in the same row. The driving polarities of the sub-pixels in the same pixel unit are the same, and the driving polarities include positive frame driving and negative frame driving. The array substrate includes: first-row pixels including a plurality of first pixel units such as pixel unit 101, pixel unit 102, pixel unit 103, pixel unit 104, etc., and the driving polarities of the sub-pixels of the first pixel unit are different; second-row pixels adjacent to the first-row pixels including a plurality of second pixel units such as pixel unit 201, pixel unit 202, pixel unit 203, pixel unit 204, etc., and driving polarities of sub-pixels of adjacent second pixel units are different; wherein in a column direction, driving polarities of the sub-pixels of adjacent first pixel unit and second pixel unit are different.

In some embodiments, the array substrate further includes: third-row pixels adjacent to the second-row pixels, the third-row pixels including a plurality of third pixel units such as pixel unit 301, pixel unit 302, pixel unit 303, pixel unit 304, etc., and driving polarities of sub-pixels of adjacent third pixel units are different; fourth-row pixels adjacent to the third-row pixels, the fourth-row pixels including a plurality of fourth pixel units such as pixel unit 101, pixel unit 102, pixel unit 103, pixel unit 104, etc., and driving polarities of sub-pixels of adjacent fourth pixel units are different; wherein in the column direction, driving polarities of sub-pixels of adjacent third pixel unit and second pixel unit are different, and driving polarities of sub-pixels of adjacent fourth pixel unit and third pixel unit are different.

In some embodiments, the array substrate is provided with data lines arranged in parallel in the column direction and gate lines arranged in parallel in a row direction. The data lines are represented as $D_1, D_2, D_3, D_4, D_5 \ldots D_n$, and the gate lines are represented as $G_1, G_2, G_3, G_4, G_5 \ldots G_n$. One pixel unit is connected to one data line and two gate lines. The driving polarities of sub-pixels of pixel units connected to one data line are same. The same data line is connected to both first pixel unit and second pixel unit. In the row direction, sub-pixels of different light emission states are alternately arranged, sub-pixels of same light emission states are connected to one scan line, and the light emission states includes a bright state and a dark state. In the row direction, gate driver on array (GOA) units corresponding to scan lines connecting sub-pixels of different light emission states are positioned on different sides of a display area.

In some embodiments, the pixel unit includes two sub-pixels with different light-emitting colors. In one row, the sub-pixels are repeatedly arranged in an order of red sub-pixel, green sub-pixel, blue sub-pixel, and red sub-pixel. The sub-pixels include red sub-pixel R, green sub-pixel G, and blue sub-pixel B. The sub-pixels have a bright state and a dark state, the bright state is represented by H, and the dark state is represented by L. The pixels connected by the positive frame drive are represented by +, and the pixels driven by the negative frame are represented by −. As shown in FIG. 1, RH+ represents that the red sub-pixel displays its bright state under the positive frame driving.

In some embodiments, the positive frame signal and the negative frame signal are symmetrical with respect to the common electrode voltage of the color filter substrate. The positive frame signal is a positive voltage relative to the common electrode voltage of the color filter substrate, and the negative frame signal is a negative voltage relative to the common electrode voltage of the color filter substrate. The voltage of the common electrode of the color filter substrate is kept unchanged, and an electrical signal with a changed polarity of the voltage is applied to the liquid crystal molecules to realize AC driving of the liquid crystal molecules. High and low potential of the positive frame voltage and the negative frame voltage correspond to a gray value of light emitted by a pixel. The high potential corresponds to a first gray value H, and the low potential voltage corresponds to a second gray value L, the first gray value represents a bright state, and the second gray value represents a dark state. The two sub-pixels included in the pixel unit respectively correspond to the first gray value and the second gray value. In the column direction, the gray values corresponding to adjacent sub-pixels are different. The voltage as shown in FIG. 2 is applied to the array substrate. In a first frame, the pixel unit of positive frame driving receives a positive voltage, the sub-pixels that receive high potential emit bright light, and the sub-pixels that receive low potential emit dark light. The pixel unit of negative frame driving receives a negative voltage, the sub-pixels that receive high potential emit bright light, and the sub-pixels that receive low potential emit dark light. In a second frame, the voltage received by the positive frame and negative frame is converted. Since the driving polarities of adjacent pixel units are different in the column direction, when the frame conversion is performed row by row, the frequency of the bright and dark alternation in each column is different, which alleviates the generation of dynamic dark lines.

Figure 4:
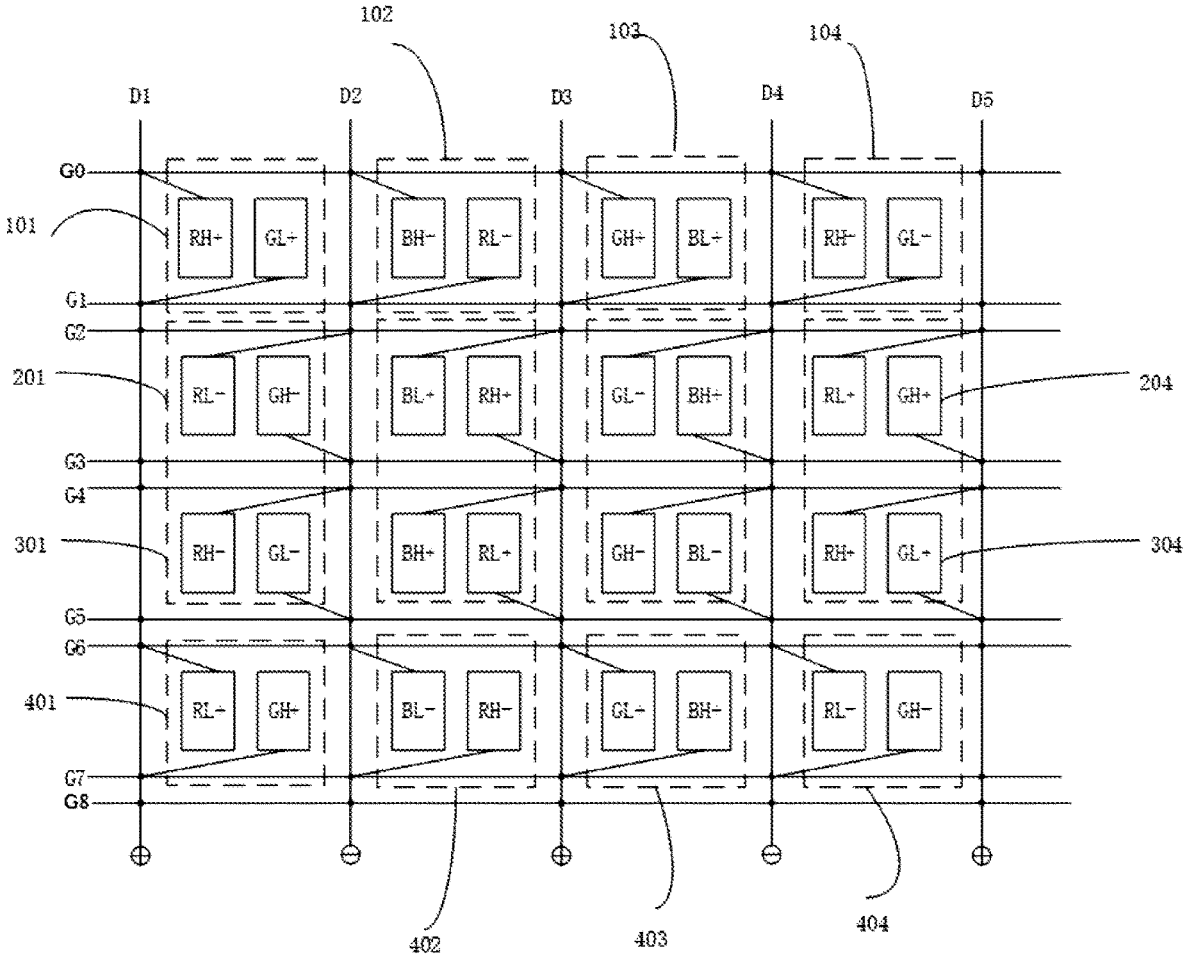
FIG. 4 is a schematic diagram of a pixel arrangement of a second type of array substrate provided by an embodiment of the present invention.

As shown in FIG. 4, the present application provides an array substrate. The array substrate includes pixel units arranged in an array, each of the pixel units include at least two sub-pixels in the same row, wherein driving polarities of the sub-pixels in the same pixel unit are same, and the driving polarities include a positive frame driving and a negative frame driving. The array substrate further including: first-row pixels including a plurality of first pixel units such as pixel unit 101, pixel unit 102, pixel unit 103, pixel unit 104 . . . , and driving polarities of sub-pixels of adjacent first pixel units are different; second-row pixels adjacent to the first-row pixels, including a plurality of second pixel units such as pixel unit 201, pixel unit 202, pixel unit 203, pixel unit 204 . . . , and driving polarities of sub-pixels of adjacent second pixel units are different; wherein in a column direction, driving polarities of the sub-pixels of adjacent first pixel unit and second pixel unit are different.

In some embodiments, the third-row pixels include a plurality of third pixel units. The third pixel units include a pixel unit 301, a pixel unit 302, a pixel unit 303, a pixel unit 304 . . . , and driving polarities of sub-pixels of adjacent third pixel units are different; fourth-row pixels adjacent to the third-row pixels, the fourth-row pixels include a plurality of fourth pixel units. The fourth pixel units include a pixel unit 401, a pixel unit 402, a pixel unit 403, a pixel unit 404 . . . , and driving polarities of sub-pixels of adjacent fourth pixel units are different; wherein in the column direction, driving polarities of sub-pixels of adjacent third pixel unit and second pixel unit are different, and driving polarities of sub-pixels of adjacent fourth pixel unit and third pixel unit are different.

In some embodiments, the pixel unit includes two sub-pixels with different light-emitting colors. In the same row, the sub-pixels are repeatedly arranged in an order of red sub-pixel, green sub-pixel, blue sub-pixel, and red sub-pixel. The sub-pixels include red sub-pixel R, green sub-pixel G, and blue sub-pixel B. The sub-pixels have a bright state and a dark state, the bright state is represented by H, and the dark state is represented by L. The pixels connected by the positive frame drive are represented by +, and the pixels driven by the negative frame are represented by −. As shown in FIG. 1, RH+ represents that the red sub-pixel displays its bright state under the positive frame driving.

In some embodiments, the positive frame signal and the negative frame signal are symmetrical with respect to the common electrode voltage of the color filter substrate. The positive frame signal is a positive voltage relative to the common electrode voltage of the color filter substrate, and the negative frame signal is a negative voltage relative to the common electrode voltage of the color filter substrate. The voltage of the common electrode of the color filter substrate is kept unchanged, and an electrical signal with a changed polarity of the voltage is applied to the liquid crystal molecules to realize AC driving of the liquid crystal molecules. High and low potential of the positive frame voltage and the negative frame voltage corresponds to a gray value of light emitted by a pixel. The high potential corresponds to a first gray value H, and the low potential voltage corresponds to a second gray value L, the first gray value represents a bright state, and the second gray value represents a dark state. The two sub-pixels included in the pixel unit respectively correspond to the first gray value and the second gray value. In the column direction, the gray values corresponding to adjacent sub-pixels are different. The signal shown in FIG. 2 is applied to the data line. In a first frame, the pixel unit of positive frame driving receives a positive voltage, the sub-pixels that receive high potential emit bright light, and the sub-pixels that receive low potential emit dark light. The pixel unit of negative frame driving receives a negative voltage, the sub-pixels that receive high potential emit bright light, and the sub-pixels that receive low potential emit dark light. In a second frame, the voltage received by the positive frame and negative frame is converted. Since the driving polarities of adjacent pixel units are different in the column direction, when the frame conversion is performed row by row, the frequency of the bright and dark alternation in each column is different, which alleviates the generation of dynamic dark lines.

The array substrate of this embodiment can be applied to a liquid crystal display panel of a liquid crystal display device. The liquid crystal display device may be a liquid crystal display television, a mobile phone, a telephone, a desktop computer, a notebook computer, a tablet computer, etc. In some embodiments, the liquid crystal display panel includes a color filter substrate and an array substrate disposed oppositely, and a liquid crystal cell disposed between the color filter substrate and the array substrate. The color filter substrate is provided with a common electrode, and the array substrate is provided with a pixel electrode, and the common electrode and the pixel electrode are arranged oppositely.

Figure 5:
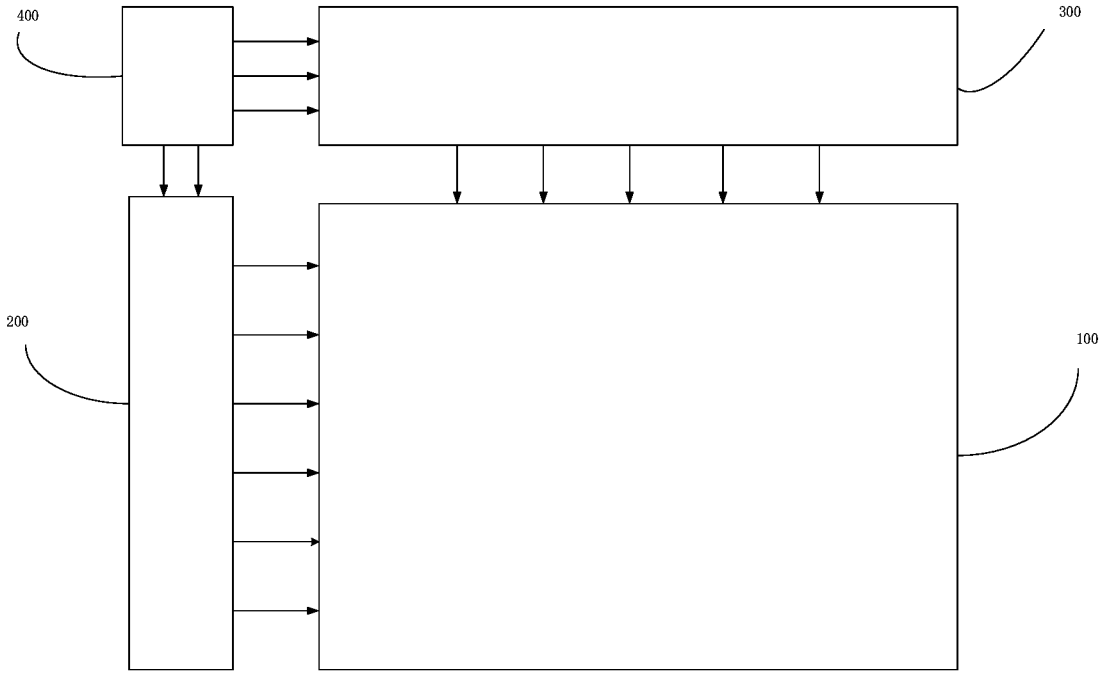
FIG. 5 is a schematic structural diagram of a display panel provided by an embodiment of the present invention.

As shown in FIG. 5, the present application also provides a display panel, including the above-mentioned array substrate 100, a GOA unit 200, a data driving chip 300, and a timing controller 400. The array substrate 100 includes gate lines, driving lines, and pixel units arranged in an array. The pixel unit includes at least two sub-pixels in the same row, wherein driving polarities of the sub-pixels in the same pixel unit are same, and the driving polarities include a positive frame driving and a negative frame driving. The array substrate further includes: first-row pixels including a plurality of first pixel units, and driving polarities of sub-pixels of adjacent first pixel units are different; second-row pixels adjacent to the first-row pixels, including a plurality of second pixel units, and driving polarities of sub-pixels of adjacent second pixel units are different; wherein in a column direction, driving polarities of the sub-pixels of adjacent first pixel unit and second pixel unit are different.

In some embodiments, the data driving chip 300 transmits an original signal to the timing controller 400. The timing controller 400 converts the original signal into a timing signal and transmits the timing signal to the GOA unit 200. The GOA unit converts the timing signal into a driving voltage to drive the driving electrodes of the array substrate 100.

In some embodiments, the display panel further includes an array substrate and a color filter substrate disposed oppositely, and a liquid crystal cell disposed between the array substrate and the color filter substrate. The array substrate includes scan lines, gate lines, and pixel electrodes. The color filter substrate includes a color filter common electrode. In this application, the voltage of the common electrode of the color filter substrate is kept unchanged, the pixel electrode is applied to floating voltage relative to the common electrode of the color filter substrate. The AC driving of liquid crystal molecules is realized by the voltage signal with a change in positive and negative polarity, wherein the positive electrical signal corresponds to the positive frame pixel, and the negative electrical signal corresponds to the negative frame pixel.

In some embodiments, the GOA unit corresponding to the positive frame pixel and the GOA unit corresponding to the negative frame pixel are positioned on both sides of the array substrate.

The present application provides an array substrate and a liquid crystal display panel. The array substrate includes pixel units arranged in an array. The pixel unit includes at least two sub-pixels arranged in the same row, driving polarities of the sub-pixels in the same pixel unit are same, and the driving polarities include positive frame driving and negative frame driving, wherein in the row direction, driving polarities of sub-pixels of adjacent pixel units are different, and in the column direction, driving polarities of adjacent first-row pixel units and second-row pixel units are different. In this application, by making certain changes to the pixel arrangement of the array substrate, the pixel units driven by the positive frame and the pixel units driven by the negative frame are alternately arranged. This alleviates the problem of the prior art that dynamic dark lines occur during frame conversion caused by the pixel units with same driving polarity in the column direction of the array substrate, thereby improving the display effect.

In the above-mentioned embodiments, the description of each embodiment has its own focus. For parts that are not described in detail in an embodiment, reference may be made to related descriptions of other embodiments.

The display panel and manufacturing method thereof provided by the embodiments of the present application are described in detail above. Specific examples are used to illustrate the principles and implementation of the application, and the description of the above examples is only used to help understand the technical solutions and core ideas of the application. Those of ordinary skill in the art should understand that: they can still modify the technical solutions stated in the embodiments, or equivalently replace some of the technical features. However, these modifications or replacements do not cause the essence of the corresponding technical solutions to deviate from the scope of the technical solutions of the embodiments of the present application.

What is claimed is:

1. An array substrate, comprising:

pixel unit columns, wherein each pixel unit column comprises pixel units arranged in a row direction, and each pixel unit comprises a pair of sub-pixels with a same driving polarity, wherein driving polarities of pairs of sub-pixels in any two adjacent pixel units are different, wherein each sub-pixel has a light emission state of a bright state or a dark state, and sub-pixels of a same light emission state in a same row are connected to a same scan line; and data lines arranged in the column direction and gate lines arranged in the row direction and intersecting with the data lines, wherein each pixel unit column is arranged between two adjacent data lines;

wherein each data line is alternately connected to pixel units in two pixel unit columns on both sides of the data line, wherein in each pair of sub-pixels of the pixel units, sub-pixels closer to the data line are set to be the bright state, and sub-pixels farther away from the data line are set to be the dark state, and wherein each pair of sub-pixels in each of the pixel units are connected to the same data line.

2. The array substrate according to claim 1, wherein each pixel unit comprises two sub-pixels with different light-emitting colors.

3. The array substrate according to claim 2, wherein the data lines are arranged in parallel in the column direction and the gate lines are arranged in parallel in the row direction, and one pixel unit is connected to one data line and two gate lines.

4. The array substrate according to claim 3, wherein driving polarities of sub-pixels of pixel units connected to a same data line are same.

5. The array substrate according to claim 3, wherein in the row direction, sub-pixels of different light emission states are alternately arranged.

6. The array substrate according to claim 5, wherein gate driver on array (GOA) units corresponding to scan lines connecting sub-pixels of different light emission states are positioned on different sides of a display area.

7. A liquid crystal display panel, comprising the array substrate of claim 1.

8. The liquid crystal display panel according to claim 7, wherein each pixel unit comprises two sub-pixels with different light-emitting colors.

9. The liquid crystal display panel according to claim 7, wherein the data lines arranged in parallel in the column direction and the gate lines arranged in parallel in the row direction, and one pixel unit is connected to one data line and two gate lines.

10. The liquid crystal display panel according to claim 9, wherein driving polarities of sub-pixels of pixel units connected to a same data line are same.

11. The liquid crystal display panel according to claim 9, wherein in the row direction, sub-pixels of different light emission states are alternately arranged.

12. The liquid crystal display panel according to claim 11, wherein gate driver on array (GOA) units corresponding to scan lines connecting sub-pixels of different light emission states are positioned on different sides of a display area.

13. The liquid crystal display panel according to claim 7, further comprising a data driving chip and a timing controller, wherein the data driving chip is configured to transmit an original signal to the timing controller, and the timing controller is configured to convert the original signal into a timing signal and transmit the timing signal to GOA units.

* * * * *